United States Patent [19]

Behringer et al.

[11] Patent Number: 4,527,976

[45] Date of Patent: Jul. 9, 1985

[54] DENTIST CHAIR

[75] Inventors: Wolfgang Behringer, Bensheim; Klaus Stöckl, Heppenheim; Rolf-Juergen Weiland, Lautertal, all of Fed. Rep. of Germany

[73] Assignee: Siemens Aktiengesellschaft, Berlin and Munich, Fed. Rep. of Germany

[21] Appl. No.: 516,160

[22] Filed: Jul. 22, 1983

[30] Foreign Application Priority Data

Aug. 2, 1982 [DE] Fed. Rep. of Germany ..... 3228853

[51] Int. Cl.[3] ..... A61G 15/00

[52] U.S. Cl. ..... 433/33; 297/71; 297/347

[58] Field of Search ..... 433/33, 98; 297/135, 297/217, 345, 347, 71

[56] References Cited

U.S. PATENT DOCUMENTS

| | | | |
|---|---|---|---|
| 3,719,391 | 3/1973 | Neri | 297/71 |
| 3,804,460 | 4/1974 | Leffler | 297/347 |
| 4,114,274 | 9/1978 | Jones | 433/98 |
| 4,145,813 | 3/1979 | Hall | 433/98 |

FOREIGN PATENT DOCUMENTS

| | | | |
|---|---|---|---|
| 2946593 | 5/1981 | Fed. Rep. of Germany | 433/33 |

*Primary Examiner*—John J. Wilson

*Attorney, Agent, or Firm*—Karl F. Milde, Jr.

[57] ABSTRACT

The invention relates to a dentist chair with a chair top carrying at least a chair seat. A chair bottom contains a height-adjusting system for the chair top, and at least one apparatus adaptable at the chair bottom which requires various supplies, such as air, water, electric current, which by means of supply lines are brought into the apparatus through the chair bottom from a connection box at the floor. For hookup of the apparatus the chair bottom contains a hookup portion which contains coupling means both for mechanical coupling and for coupling of the various other supply lines. The apparatus is connectible to the supply lines through a counter-piece which matches the hookup portion of the chair bottom and which, for mechanical coupling of the apparatus contains counter-coupling means which can be brought into engagement with the coupling means and which then establishes the proper required connection.

7 Claims, 10 Drawing Figures

DENTIST CHAIR

BACKGROUND OF THE INVENTION

The invention relates to a dentist chair, with a top portion carrying at least a patient seat, with the bottom portion containing a height-adjusting system for the chair top, and with at least one apparatus adaptable at the chair bottom which requires various supply lines, such as air, water, or electric current, which are brought into the apparatus through the chair bottom by supply lines from a connection box situated at the floor.

In a known dentist chair of this kind (German patent No. DE-OS 29 46 593), the supply lines extend through the chair bottom to an outlet opening located near the apparatus, where they emerge, discharging directly into the interior of the apparatus. At one or more points the supply lines are fixed by fasteners or the like, and in this region they may also be transversely divided, the divided ends being then jointed together by a terminal strip or a multiple plug. the coupling of the apparatus occurs by way of a carrier designed as a slide track, screwed to the chair top support as a separate part. Lastly, various trim parts cover up the internal parts of the slide track.

To connect the apparatus to the chair requires a relatively high expense of installation. First the apparatus must be coupled to the chair mechanically; then the individual supply lines must be hooked up; and lastly the internal parts of the slide track must be covered by appropriate trim parts. Furthermore, the lateral adaption of the slide track, formed as a separate structural part with a torsionally rigid housing of its own, results in undesired projections and joints, so that compactness of design is not achieved.

SUMMARY OF THE INVENTION

It is the object of the present invention to provide an improved dentist chair. That is, the object is to provide a dentist chair of the above mentioned kind where through compact construction, the cost of installation and connection of the apparatus to the chair can be reduced. In particular, easier installation at the customer site than previously available, is to be made possible.

To achieve this objective, the invention discloses an interconnection device for connecting the apparatus to the chair bottom, which contains a hookup portion containing coupling means for mechanical coupling as well as for coupling the various supply lines. Also disclosed is that the apparatus to be connected comprises a counter-piece matching the hookup portion of the chair bottom, the counter-piece containing counter-coupling means which, for mechanical coupling of the apparatus, can be brought into engagement with the coupling means and which then establish the connection of the supply lines.

Due to the mechanical coupling of the apparatus to the chair the supply lines are effectively connected together ready for operation, and consequently the assembly of the apparatus is greatly simplified. The chair bottom can be assembled and fitted with the necessary supply lines at the factory and be finished and tested to such an extent that at the customer site, the apparatus need only be coupled to the chair. The hookup portion, which contains all electrical, pneumatic and hydraulic connection elements, can advantageously be used at the same time as a test adapter, which allows the checking of the operation of the supply line installation at the factory prior to shipment.

An especially advantageous embodiment provides a first hookup portion at the chair bottom near the floor for connecting a doctor's apparatus and a second hookup portion at the height-adjustable top support—away from the floor—for a patient-related apparatus with spittoon and rinsing facilities, often referred to as water unit or assistant's apparatus. The hookup portions are advantageously fastened to a guiding carriage which forms part of a slide track integrated in the chair bottom section. The slide track for the floor hookup portion may advantageously extend over the full length of the base portion of the chair, starting approximately at the rear edge of the seat and ending approximately in the region of the front edge of the footrest. For the slide track of the hookup portion away from the floor, on the other hand, it suffices if on the other side of the chair opposite the floor hookup portion, it is arranged on the seat support. The slide track for the upper hookup portion is of a length corresponding to only about the seat length. The base portion and seat support form along the chair axis a free space, in which the guiding carriage is mounted for longitudinal displacement. Laterally of the centrally arranged height-adjusting system and lying inside the outer limits of the chair bottom, a cable duct is provided, in which the supply lines coming from the connection box are routed, in the form of a cable loop, to the hookup portion connected with the guiding carriage.

Embodiments of the invention will be explained more specifically below with reference to the drawings.

DETAILED DESCRIPTION

Figure 1:
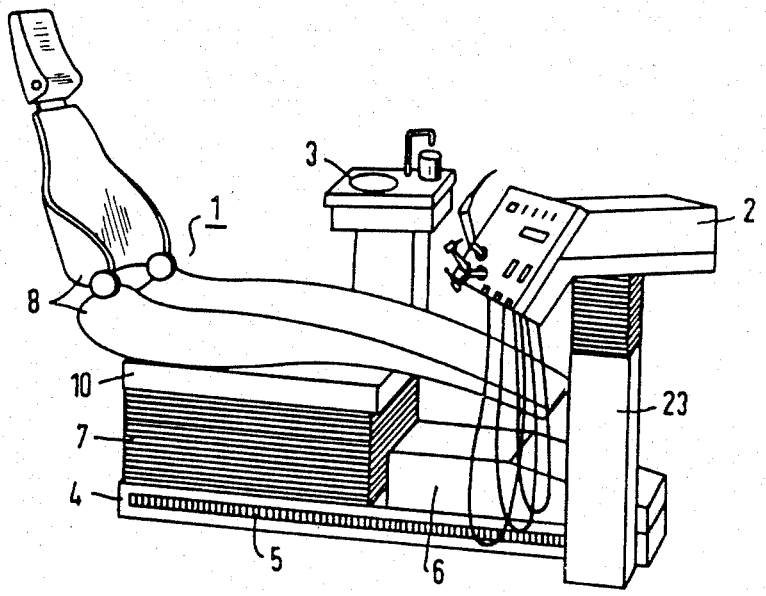
FIG. 1 shows a dentist work station in a simplified perspective representation.

FIG. 1 shows in perspective a dentist work station, consisting of a chair 1, a doctor's apparatus 2 disposed to the right thereof viewed from the patient, and an assistant's apparatus 3 disposed to the left of the chair. The chair 1 consists essentially of a top and a bottom. The chair bottom contains a base portion 4, in which are arranged a first horizontal guide 5, to be explained later, for the doctor apparatus 2, and electrical and/or pneumatic supply components combined in a connection box 6, as well as a height adjusting device covered up by a bellows or accordion 7 for the chair top 8 consisting of the seat and backrest. The assistant's apparatus 3 is also mounted for adjustment parallel to the longitudinal axis of the chair by means of a second horizontal guide 9 (FIG. 2), but in contrast to the first horizontal guide 5 for the doctor apparatus 2—which extends at the fixed base portion 4 over the full length of the chair, hence approximately from the rear seat edge to at least the foot end of the seat or respectively to what in FIG. 1 is the right end of the connection box 6—the second horizontal guide 9 for the assistant apparatus 3 extends at the vertically adjustable chair top support 10 only over the length thereof.

Figure 2:
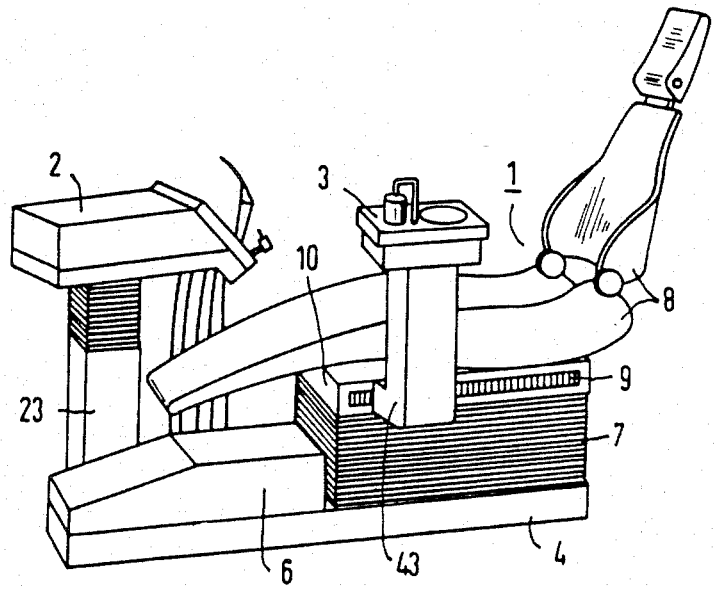
FIG. 2 shows the work station of FIG. 1 seen from the opposite side.
Figure 3:
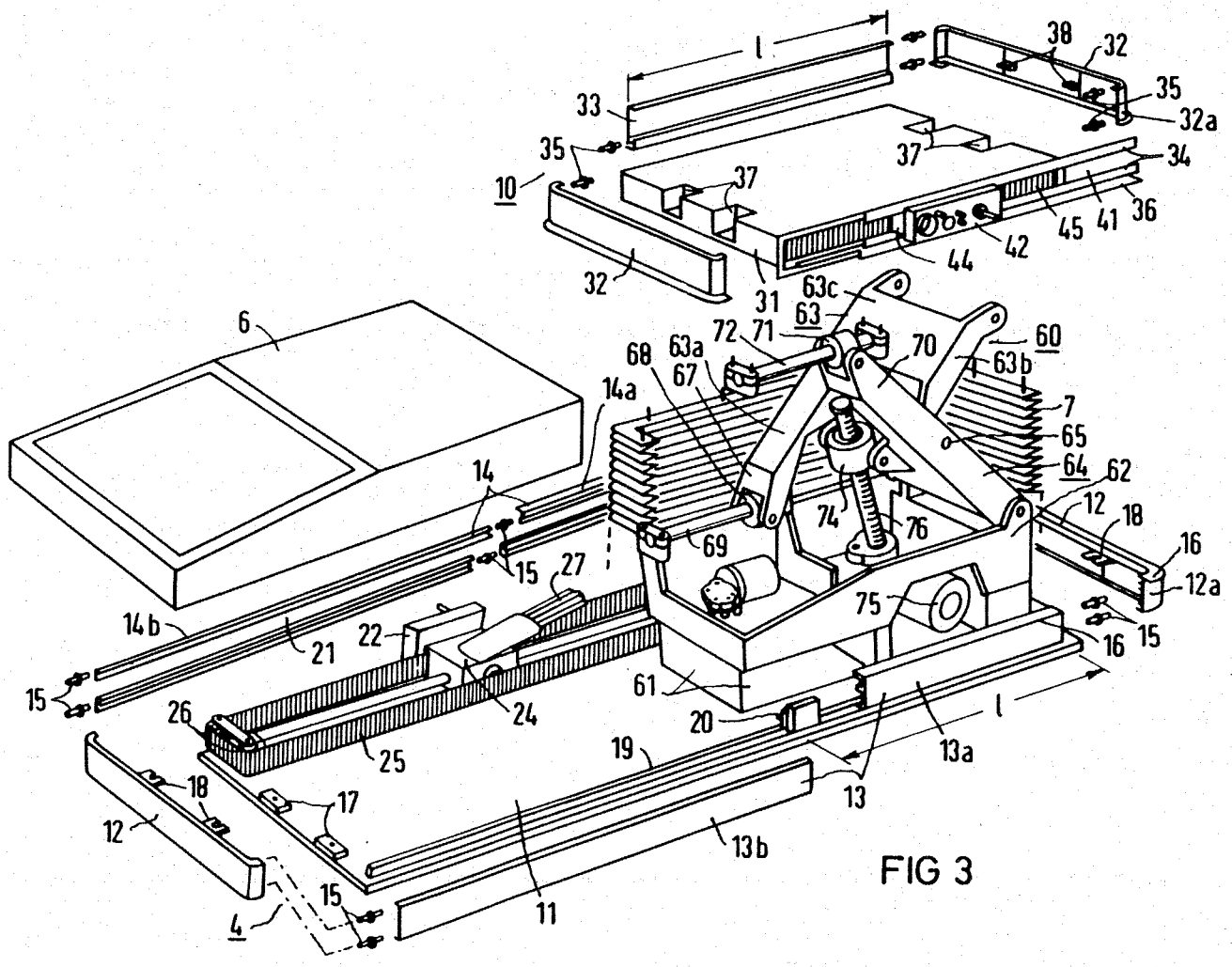
FIG. 3 shows the construction of the chair bottom with the height-adjusting system in an exploded view.

FIG. 3 shows the construction of the chair bottom including the chair top support in an exploded view. The view is taken from the side from which FIG. 2 is to be viewed.

The base portion 4 is formed essentially of a bottom plate 11 of rectangular plan, which receives all carrying parts, in particular the height-adjusting system marked 60 and the chair top support 10 and of a frame surrounding the bottom plate 11, which frame in turn is formed by two endpieces 12 on the shorter sides and trim parts 13 on the longer sides as well as sectional elements 14. The endpieces 12 constitute corner sections, i.e. they have end portions 12*a* which are bent at right angles and span the shorter sides of bottom plate 11 and into which the elastic connecting elements 15 can be attached. The right-hand portion of endpiece 12 shown in the figure contains a shoulder 16, where the lower end of the accordion 7 is hooked in. The endpieces 12 are screwed to the bottom plate 11, for which purpose attachment blocks 17 are arranged on the latter, and tabs 18 at the endpieces 12.

The full-area trim parts 13 are transversely divided into a section 13*a*, corresponding substantially to the length of the chair top support 10 or of the accordion 7 embracing the height-adjusting device, and a section 13*b*, which corresponds to the remaining lenght, essentially the length of the connection box 6. At the joint, a holder 20 is provided which is attached to the base plate 11 or respectively to a strip 19 connected with the latter and is adapted to the contour of the trim parts 13, the trim parts 13*a*, 13*b* being slipped onto said holder by one of their respective ends for fixation before being connected at their other ends with the endpieces 12 by means of the elastic connecting elements 15. The trim part 13*a*, like the right endpiece 12, also has a shoulder 16 where the accordion 7 is hooked in. The transverse division exists also at the angle sections 14: Here, too, the individual parts are connected together by elastic connecting elements 15; the upper angle section 14*a* contains, like the trim part 13*a*, a corresponding shoulder 16, for attachment of the accordion 7.

An essential advantage of the transverse division of the trim parts and angle sections in the manner described is to be seen in that identical trim parts can be used for the trim of the seat support and of the base portion, and this for a chair design both with a short base portion, e.g. without connection box, and with long base portions, e.g. with connection box.

Over their entire length the two sectional elements 14 form a slit 21, from which a hookup or support portion 22 protrudes, on which the support column 23—bent at the foot—(FIG. 1) for the apparatus 2 can be attached. The support portion 22 is firmly connected with a carriage 24 which is guided inside the base portion 4 over the full length of slit 21 in the first horizontal guide 5.

In every position of carriage 24, the slit 21 is covered up by a belt 25 hooked in at the carriage 24, which belt is guided as an endless belt over guide rolls 26 in approximately rectangular form. Opening into the carriage 24 are further several supply lines 27 joined together in a flat band, which bring required supply lines into the apparatus 2 (air and/or water and/or electric current) from a central supply source in the connection box 6 to the support portion 22.

To match the construction of the base portion 4, the chair top support 10 also consists of a bottom plate 31 of rectangular plan and of the same width as the bottom plate 11, and of a frame consisting firstly of endpieces 32 on both sides and secondly of trim parts 33 as well as angle sections 34, which in turn are attached at the endpieces by means of corresponding elastic connection elements 35. At the endpieces and at the angle sections shoulders 36 are provided, where the accordion 7 can be hooked in.

The endpieces 32 are identical with the endpieces 12, hence at the same point and at the same level they have attachment tabs 38; the respective mounts 37 are provided in the bottom plate 31. Also the trim parts 33 have the same dimensions as the trim sections 13*a*, so that, among other things, stocking of parts is simplified since the parts are interchangeable. Thus, for example, the righthand endpiece 12 (with shoulder) of the base portion 4 can be used as a trim part for the top portion support.

Again there extends through the slit 41 formed by the two angle sections 34 a hookup or support part 42, where the support column 43 (FIG. 2) of apparatus 3 is attached either directly or through a support arm. As in base portion 4, the slit is covered by a belt 45.

Referring to FIGS. 3 through 9, the construction of the lift device for adjustment of the chair top will be explained more specifically.

Integrally formed on the bottom plate 11 of base portion 4 are pedestal parts 61, on which is fastened a box type frame 62 open toward the top and bottom. A scissor arm construction formed of two parts 63, 64 is articulated on the one hand to the frame 62 and on the other to the chair top support 10.

Except for the hinge point of a drive to be explained more specifically later, the scissor arm parts 63, 64 are identical, i.e. they each form a long arm 63*a*, a short arm 63*b*, and a cross reinforcement 63*c* lying therebetween. The shorter arm 63*b* or 64*b* is about half as long as the longer arm 63*a* or 64*a* and is guided in a joint axle bearing 65. The ends 66 of the parallel arms 63*a*, 63*b*, ending at the same level, are mounted at the chair top support 10; the free end 67 of the longer arm 63*a* is articulated to a bushing 68, which together with a guide rod 69 fastened on the frame 62 forms a horizontal guide.

The equivalent applies to the scissor arm part 64, whose free end 70 is articulated to a bushing 71, which is guided by a guide rod 72 fastened to the chair top support 10. At the scissor arm part 64 are arranged mounting and bearing parts 73 for a spindle nut 74 which is part of a spindle drive whose drive motor 75 is fastened on the bottom plate 11 and whose spindle 76 engages through the frame 62.

Figure 4:
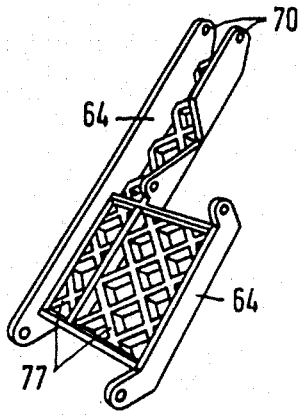
FIG. 4 shows a part of the lifting device, in perspective.

FIG. 4 shows the scissor arm part 64 from the back. It can be seen from the illustration that both the scissor arm part 64 as such as well as the long arm 64*a* are of U-shaped cross-section and that between them are provided diagonally extending stiffening ribs 77. This makes the entire scissor arm construction extremely torsionstiff.

Figure 5:
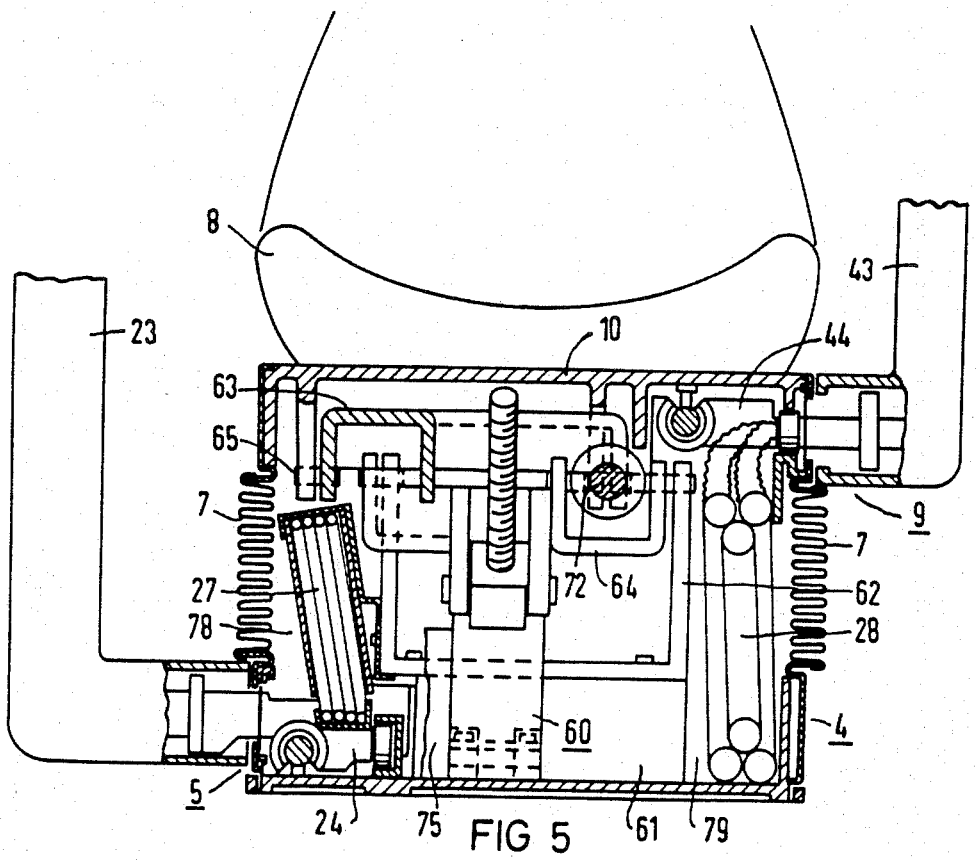
FIG. 5 shows the chair bottom in transverse section.

As can be seen from FIGS. 3 and 5, the two scissor arm parts 63 and 64 are arranged relative to each other in such a way that the sides of the U-shaped arms are turned toward each other. Thus, the two scissor arm parts can be arranged horizontally in the lowest position (FIG. 5). Through the interengagement of the scissor arm parts even a still lower end position would be possible, should this be necessary for certain structural requirements.

The design of the lift device in the manner described makes it possible to construct an extremely narrow lift device, whereby in comparison with other designs more free space is created laterally of the scissor arm parts.

Another advantage is that below the scissor arms lying horizontally in the lowest portion sufficient space is created for accommodating the supply lines.

The base portion 4 and chair top support 10 form on either side of the height-adjusting system 60 a free space 78, 79 serving as cable duct for the cables 27 and 28. This free space extends parallel to the longitudinal axis of the chair and is limited on the one hand by the pedestal and frame parts 61, 62 and on the other hand by the bellows or accordion 7. The supply lines 27, 28 are combined in the manner of a flat cable and installed in cable ducts 78, 79 forming a loop, so that they can follow the movement of the apparatus. One end of each of the lines opens into the carriage 24 or respectively 44, hence moving along over the guide track, while the other end opens into the connection box 6. Since, in contrast to the lines 27, the supply lines 28 for the assistant's apparatus 3 must participate not only in the reciprocating movement but also in the height-adjusting movement of the chair top support 10, the length of the lines is here such that in the respective end positions they are still sufficiently guided inside the cable duct.

Figure 6:
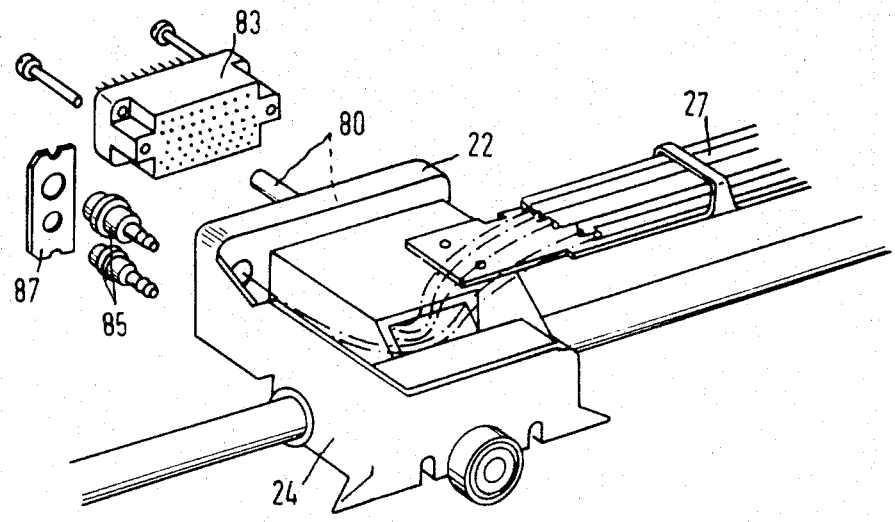
FIG. 6 shows a detail of FIG. 3 with the hookup portion for the adaptable apparatus near the floor (item 2 in FIG. 1).
Figure 8:
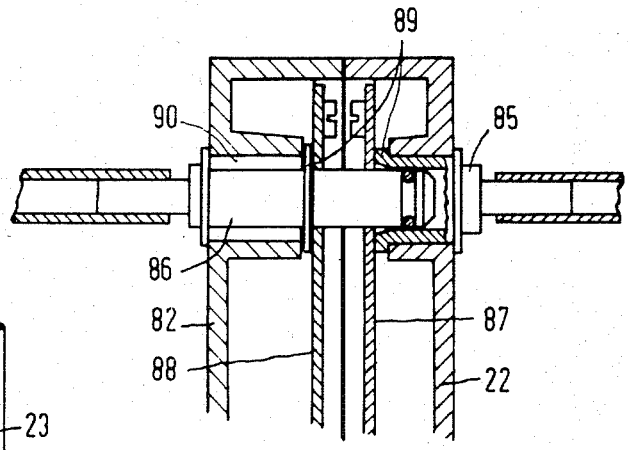
FIG. 8 shows a part of the hookup portions shown in FIGS. 6 and 7 in the mounted state and in longitudinal section along lines VIII/VIII in FIGS. 6 and 7.
Figure 7:
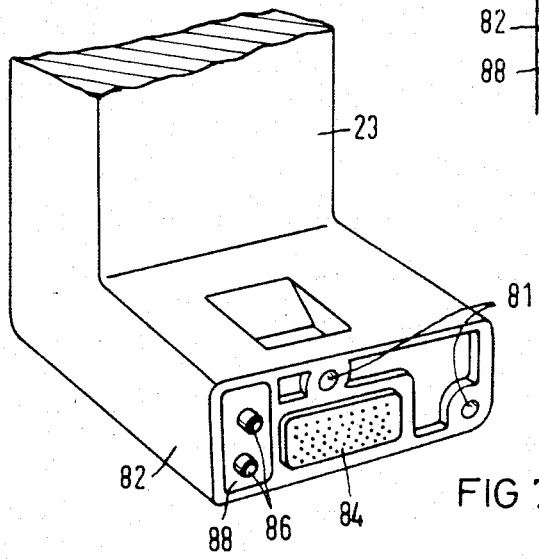
FIG. 7 shows the respective apparatus-side counterpiece.

Referring to FIGS. 6 to 10, the construction of the means provided for the adaptation and coupling of the apparatus and chair are explained more specifically below. FIG. 6 shows in a larger scale the carriage 24 with the supporting or connecting part 22 secured thereon. One the end face of part 22, two centering and holding pins 80 (only one is visible in the figure) are provided, which in the mounted state engage in corresponding holes 81 in the matching adapter counterpiece 82 of the support column 23, on which apparatus 2 is fixed. With these two pins one achieves on the one hand a mechanical coupling of apparatus and chair and, on the other hand, a centering of the other coupling members. The electrical hookup is effected by means of a multiple plug strip 83 fastened to the connection part 22, the contact pins of which, not specifically designated, engage in the coupled state in receiving parts of a corresponding counter-coupling piece 84 secured to the adapter counter-piece 82. The pneumatic and/or hydraulic connections are established by means of connecting members 85, which engage in or span corresponding counter-members 86. These connecting and counter members 85, 86 are retained by means of common guard plates 87, 88 on the respective adpater parts 22, 82. Details are shown in FIG. 8, which shows a connection in the mounted state in longitudinal section. Via a flange 89 formed by a collar or guard disk, the guard plates 87, 88 press the connection and countermembers 85, 86 against a corresponding bearing surface of the adapter part 22 or respectively 82. To provide a certain clearance compensation, at least the hole 90 in the one adapter part 82 is substantially larger that the diameter of the connection member 86 itself. The centering and retention is achieved solely by the guard plates 87, 88; the holes provided there thus determine the position of the coupling members relative to each other.

Figures 9, 10:
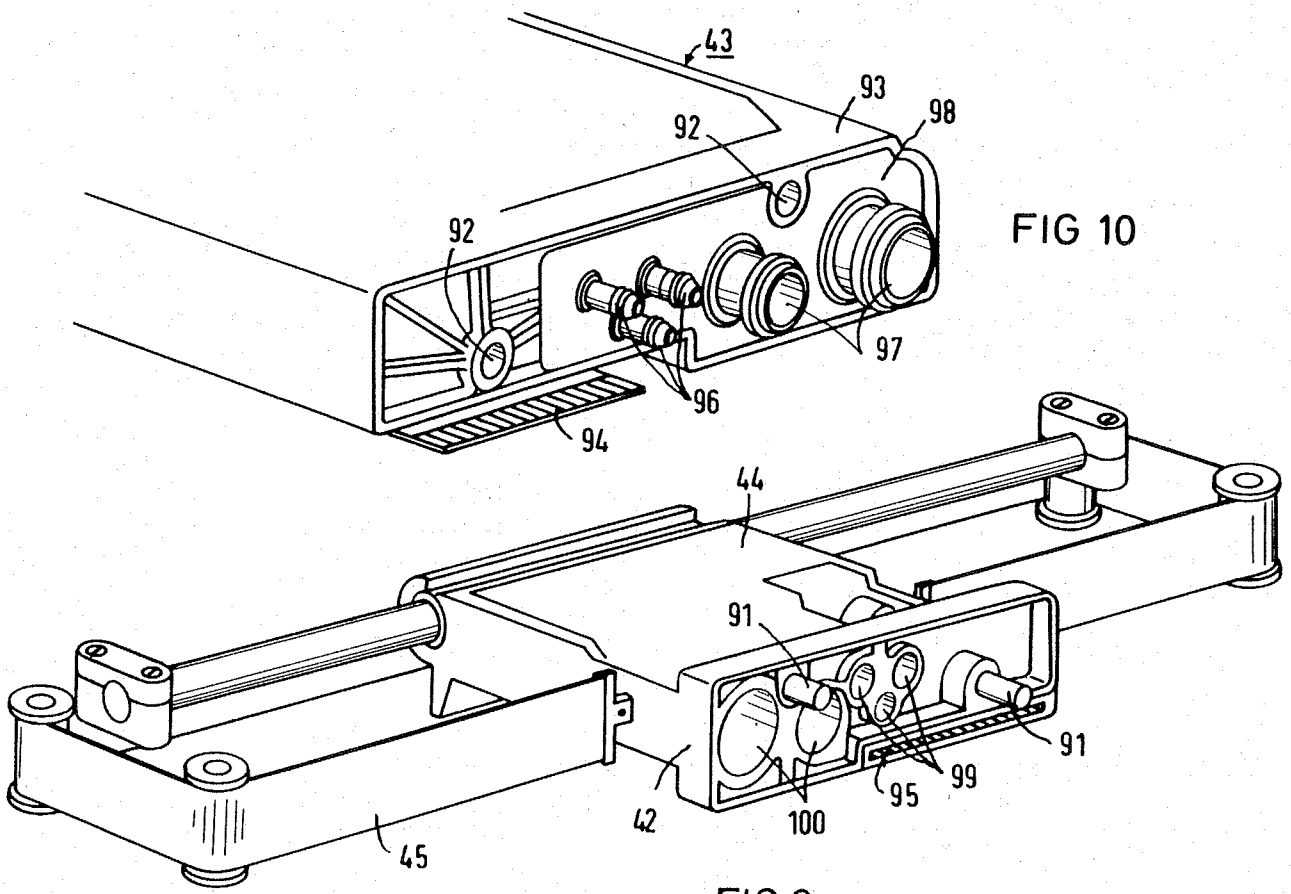
FIG. 9 shows the hookup portion for the apparatus away from the floor (item 3 in FIG. 3).
FIG. 10 shows the respective apparatus-side counterpiece together with the slide track disposed in the top carrier.

FIGS. 9 and 10, show details of the adapter parts for the apparatus 3 adaptable on the chair top support 10. The supporting or connecting part 42 attached to the carriage 44 of the slide track 9 contains two centering and retaining pins 91, which in turn engage in corresponding holes 92 in the adapter counter-piece 93 of the support column 43 for apparatus 3. A plug strip 94 with plug pins matches with a corresponding counter-piece 95 at the adapter part 42. Connection members 96 for compressed air and pressure water and 97 for suction air or respectively waste water are fastened on the adapter part 93 by a common guard plate 97. In the connection part 42, holes 99, 100 fitting the connection members 96, 97 are provided, which are connected with the supply lines 28 leading to the connection box 6.

There has thus been shown and described novel apparatus for a dentist chair which fulfills all the objects and advantages sought therefor. Many changes, modifications, variations and other uses and applications of the subject invention will, however, become apparent to those skilled in the art after considering this specification and the accompanying drawings which disclose embodiments thereof. All such changes, modifications, variations and other uses and applications which do not depart from the spirit and scope of the invention are deemed to be covered by the invention which is limited only by the claims which follow.

What is claimed is:

1. An improved dentist chair with a top portion carrying a seat, with a chair bottom containing a height-adjusting system for the seat and with a doctor's apparatus attached to said chair bottom, said doctor's apparatus being provided with various media, such as air, water or electricity, said media being routed to said doctor's apparatus through said chair bottom by supply lines from a connection box disposed at the floor, wherein the improvement comprises:

(a) a first hookup portion contained within said chair bottom for connecting said doctor's apparatus to said chair bottom, said hookup portion including a first carriage with first coupling means for mechanically coupling said doctor's apparatus to said chair bottom and second coupling means connected with said various media supply lines; and (b) a first counter-part included with said doctor's apparatus for connecting said doctor's apparatus to said chair bottom, said first counter-part having first counter-coupling means matching complementarily said first coupling means of said first hookup portion and further including second counter-coupling means for coupling with said second coupling means of said first hookup portion when the first coupling means and first counter-couping means are joined together;

whereby when said doctor's apparatus is mechanically attached at said chair bottom, the media supply lines are simultaneously connected together.

2. The chair according to claim 1 further comprising:

(a) a patient-related apparatus with spitton and rinsing facilities, said patient-related apparatus being attached to the top portion of the chair on one longitudinal side thereof and said doctor's apparatus being arranged on the other longitudinal side thereof;

(b) a second hookup portion contained within said chair top portion for connecting said patient-related apparatus to said top portion, said second hookup portion including a second carriage with third coupling means for mechanically coupling said patient-related apparatus to said top portion and fourth coupling means connected with said various media supply lines; and (c) a second counter-part included with said patient-related apparatus for connecting said patient-related apparatus to said top portion, said second counter-part having third counter-coupling means matching complementarily said third coupling means of said second hookup portion and further including fourth counter-coupling means for coupling with said fourth coupling means of said second hookup portion when the third coupling means and third counter-coupling means are joined together;

whereby when said patient-related apparatus is mechanically attached at said chair bottom, the media supply lines are simultaneously connected together.

3. The chair as in claim 2 wherein said chair further comprises:

(a) a second guiding carriage;

(b) a second slide track; and (c) a second guiding slit, which cooperate to slidably support said patient-related apparatus at said chair bottom, wherein said second hookup portion is fastened to said second guiding carriage which is contained within said chair bottom, said second guiding carriage being mounted onto said slide track allowing said second carriage to slide therealong, said second guiding slit being provided along a longitudinal side of said chair so that said second hookup portion with said third and fourth coupling means project outwardly through said second guiding slit to allow said patient-related apparatus to be mounted thereto.

4. The chair as in claim 3 wherein said first slide track extends over the full length of said chair bottom, starting approximately at the rear edge of said seat and ending at the front end of a footrest of said seat, and wherein said second slide track extends only over a length corresponding approximately to the span of said seat-carrying top portion of said chair.

5. The chair as in claim 4 wherein free spaces are provided to allow said first and second guiding carriages to be movable along the longitudinal axis of said chair, and wherein cable ducts are provided through which the media supply lines are routed in the form of cable loops toward said first and second hookup portions so that a proper connection of the media supply lines to their respective first or second hookup portion is maintained irrespective of the actual lateral or vertical position of said first or second hookup portion.

6. The chair as in claim 1 wherein said chair further comprises:

(a) a first guiding carriage;

(b) a first slide track; and (c) a first guiding slit, which cooperate to slidably support said doctor's apparatus at said chair bottom, wherein said first hookup portion is fastened to said first guiding carriage which is contained within said chair bottom, said first guiding carriage being mounted onto said first slide track allowing said first carriage to slide therealong, said first guiding slit being provided along a longitudinal side of said chair so that said first hookup portion with said first and second coupling means project outwardly through said first guiding slit to allow said doctor's apparatus to be mounted thereto.

7. The chair as in claim 1 wherein said chair further comprises a base portion, a seat support and a height adjusting system arranged between said base portion and said seat support, said base portion being the lowermost part of said chair and comprising a lower bottom plate and lower trim parts, said seat support being mounted atop said height adjusting system and supporting said seat thereon, said seat support further comprising an upper bottom plate and upper trim parts, wherein said height adjusting system is designed as a double scissor arm construction which is articulated to a frame which is secured to said lower bottom plate of said base portion, said system being surrounded by a bellows which extends from the upper edges of said lower trim parts to the lower edges of said upper trim parts to effectively cover the height adjusting mechanism as it moves said seat up or down, and wherein cable ducts are provided between said bellows and said height adjusting system through which the supply lines are routed in form of cable loops toward said first hookup portion.

* * * * *